United States Patent [19]

Giorgi et al.

[11] 4,088,456

[45] May 9, 1978

[54] VACUUM PUMPING SYSTEM AND METHOD OF USE

[75] Inventors: Tiziano A. Giorgi; Paolo della Porta, both of Milan, Italy

[73] Assignee: S.A.E.S. Getters S.p.A., Milan, Italy

[21] Appl. No.: 539,103

[22] Filed: Jan. 7, 1975

[30] Foreign Application Priority Data

Jan. 7, 1974 Italy ..... 19143 A/74

[51] Int. Cl.[2] ..... B01D 53/04

[52] U.S. Cl. ..... 55/179; 55/189; 55/195; 55/208; 55/387

[58] Field of Search ..... 55/74, 76, 179, 208, 55/387, 189, 195

[56] References Cited

U.S. PATENT DOCUMENTS

| | | | |
|---|---|---|---|
| 3,077,712 | 2/1963 | Milleron et al. | 55/208 |
| 3,469,375 | 9/1969 | Barrington et al. | 55/208 |
| 3,584,253 | 6/1971 | Wintzer | 417/51 X |

*Primary Examiner*—Charles N. Hart
*Assistant Examiner*—Richard W. Burks
*Attorney, Agent, or Firm*—Littlepage, Quaintance, Murphy, Richardson and Webner

[57] ABSTRACT

A means for connecting a vacuum pump to a chamber to be evacuated comprises an outer wall of low gas permeability and a gas sorptive means substantially coextensive with the inner surface of said outer wall.

14 Claims, 5 Drawing Figures

VACUUM PUMPING SYSTEM AND METHOD OF USE

BACKGROUND OF THE INVENTION

1. Field of the Invention

This invention pertains generally to a means for connecting a vacuum pump to a chamber to be evacuated and pertains particularly to such a connecting means which also provides a pumping action by having the specific feature of a gas sorbing material on the inner surface of the connecting means.

2. Description of the Prior Art

It is often desirable or necessary to produce a region of substantially reduced pressure or a vacuum within an enclosed space or volume. Many different methods have been proposed to produce this desired vacuum. One method in wide spread use is by means of mechanical pumps which operate by trapping gas molecules or atoms from the vessel in which it is desired to produce the vacuum. These trapped molecules or atoms are then mechanically transferred to a region of higher pressure outside the vessel. Many types of mechanical pump are known such as the rotary pump which has many variations. However these pumps are generally not capable of producing vacuua less than about $10^{-2}$ torr or about $10^{-4}$ torr when two are placed in series. They also have difficulty in pumping the gases which are easy to condense such as water vapor and additional techniques have to be used such as the addition of a gas ballast or air leak. Such mechanical pumps, while capable of removing large quantities of gases at high speeds, are not capable of reaching the low pressure which are presently required. In order to reach lower pressures mercury or oil diffusion pumps have been used. These pumps operate by providing a high speed jet of mercury or oil of lower vapor pressure. The jet or steam of mercury or oil entraps molecules or atoms of gas, which diffuse from the volume or chamber to be pumped, and remove them to a region of higher pressure. Usually the diffusion pump is aided by means of a backing pump which generally consists of a mechanical pump such as those already described. Practical considerations usually limit the lower pressure reached with these diffusion pumps to about $10^{-8}$ torr, although techniques are known by which these pumps can give better vacuua.

Many other types of pumps are known for producing vacuua such as those which operate by the evaporation of a metal, which is then capable of reacting with gas molecules or which buries them under the surface of the evaporated metal. Such pumps however can be unstable when pumping rare gases such as He, Ne, Ar, etc. and may not even pump them at all.

The so called turbo-molecular pump has also gained great favor in the production of high vacuua but its performance with respect to hydrogen is not as good as for other gases of higher atomic or molecular weight.

Very often a combination of different types of pumps is used to try and attain a more even removal of all species of gas from the chamber to be evacuated. Unfortunately the various combinations have not lead to the attainment of the extremely low partial pressure levels of all residual gases which are now known to be required in certain vacuum chambers.

The connection means between the pump and the chamber can also be a source of gas which may limit the lowest pressure attainable in the chamber.

Heating process are used to aid in reducing the quantity of gas remaining upon or within surfaces which could later be released and decrease the quality of the vacuum. It is also known to use a gas sorbing means or trap placed between the vacuum pump and the chamber however this trap is usually in the form of a separate device placed between the pump and the chamber still leaving an undesirable connection means between the trap and the chamber. The trap may be electrical in nature or consist of cooled surfaces and zeolites. Sometimes it is necessary to use cryogenic techniques which require additional ancilliary equipment.

It is therefore an object of the present invention to provide a means for connecting a vacuum pump to a chamber to be evacuated which is substantially free from one or more of the disadvantages of prior connecting means.

A further object is to provide a means for connecting a vacuum pump to a chamber required to be evacuated which also provides a pumping action.

Another object is to provide a vacuum pumping system in which there is an improved connection means between the vacuum pump and the chamber to be evacuated.

Yet another object of the present invention is to provide an improved method of pumping a chamber to sub-atmospheric pressures.

SUMMARY OF THE INVENTION

According to the present invention there is provided a means for connecting a vacuum pump to a chamber said means comprising an outer wall of low gas permeability and means for sorbing gas substantially coextensive with the inner surface of the outer wall. Such connecting means allow the attainment of better vacuua in chambers required to be evacuated and at the same time provide a distributed pumping system which has less selective pumping characteristics towards various gases than prior pumping systems.

In the broadest sense of the present invention the means for connecting the vacuum pump to the chamber to be pumped may simply be a tube of low gas permeability the inner surface of whose walls is covered with a gas sorbing material. Optionally the connecting means may be heated to improve the gas sorbing properties of the gas sorbing material. The heating may be made non-uniform so that the sorption properties are optimized for various gases.

However in a preferred embodiment the connecting means is in the form of at least two sections each section having at least one flange for connection purposes each section can be provided with an externally placed coiled heater of high electrical resistance wire. Within each section can be placed a gas sorptive means preferably coextensive with the inner surface of its walls. This gas sorptive means is preferably in the form of a replaceable cartridge which may be a hollow cylinder of support material supporting a gas sorbing material.

In the broadest aspect of the present invention the support material may be any material suitable for use in vacuum and at high temperatures and capable of supporting a gas sorbing material. Non-limiting examples of suitable materials are porous electro-graphite and networks which define a multiplicity of inter-connecting free cells which can be prepared by methods as described in United Kingdom Pat. Nos. 1,263,704 and 1,289,600. See also U.S. Pat. Nos. 3,679,522 and 3,774,427. Alternatively the support may be in the form of a metal strip as described in U.S. Pat. No. 3,620,645 which may be pleated in circular form as for example described in U.S. Pat. No. 3,662,522.

In the broadest sense of the invention the gas sorbing material may be any material capable of sorbing gas. However the preferred gas sorbing materials are non-evaporable getter materials. These non-evaporable getter materials are characterized by having a sorptive capacity for noxious gases such as oxygen, carbon monoxide, and water vapour, and a vapour pressure at 1000° C of less than $10^{-5}$ torr. Examples of suitable non-evaporable getter materials include among others Zr, Ti, Ta, Nb, V and mixtures thereof, alloys thereof with one another and with other metals such as Al.

One preferred non-evaporable getter material is an alloy of Zirconium and Aluminium having a composition of between 5% tp 30% Al balance Zr. A preferred alloy of Zirconium and Aluminium is an alloy having a composition of 16% Al - 84% Zr. Other preferred non-evaporable getter materials combine a finely powdered getter metal or alloy in mixture with an antisintering agent such as described In U.S. Pat. No. 3,584,253 or Italian Pat. Application No. 28053/A/72.

These getter materials have different sorption properties towards different gases at different temperatures. Thus the connecting means can be composed of several sections each heated to different temperatures to optimize the overall gas pumping process from the chamber. Methane and other hydrocarbons are more easily pumped if they are cracked into hydrogen. Such hydrocarbons may arise from the chamber by backstreaming from the mechanical pumps.

The wall of the connecting means may be of any material which has a low gas permeability. Examples of suitable materials are steel, stainless steel and ceramic. Stainless steel is preferred as it is easy to machine and connection of flanges is also relatively simple. Ceramic materials are preferred as they have a lower gas permeability especially at higher temperatures.

Additional features and advantages of the present invention will be apparent by reference to the following detailed description and drawings.

DESCRIPTION OF PREFERRED EMBODIMENTS

Figure 1:
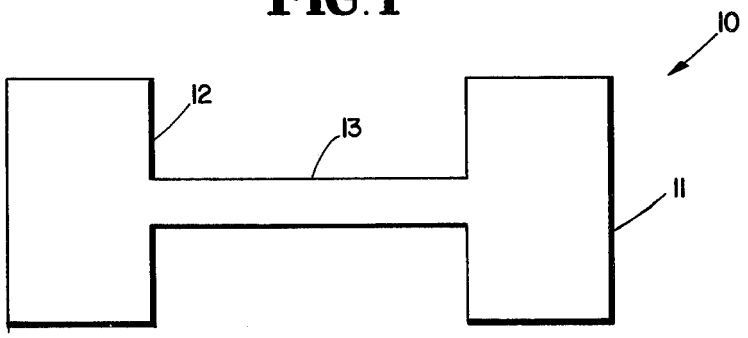
FIG. 1 is a diagramatic view of a pumping system and chamber to be evacuated not representative of the present invention.
Figure 2:
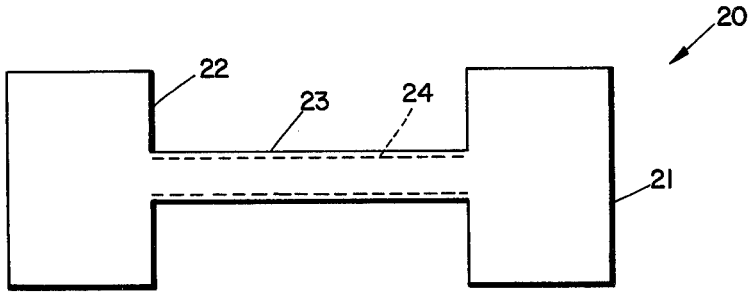
FIG. 2 is a diagramatic view of a pumping system and chamber to be evacuated according to the present invention.

Referring now to the drawings and in particular to FIG. 1, there is shown a diagramatic representation 10 of a known pumping system 11 and chamber to be evacuated 12 connected by a connecting means 13. In operation the pumping system 11, which can comprise a combination of known pumping devices, removes unwanted gases from the chamber 12. However, in this type of system connection 13 remains a source of gas and the pressure in chamber 12 cannot be reduced below certain levels. In order to reduce the pressure even further it is proposed in the present invention to make the connecting means 13 part of the pumping system. This is shown as a diagramatic representation 20 in FIG. 2, which shows a pumping system 21 and a chamber to be evacuated 22 connected by a connecting means 23. However, in FIG. 2 the connecting means 23 is covered internally by a gas sorption means 24. Thus the connecting means now forms part of the pumping system.

Figure 3:
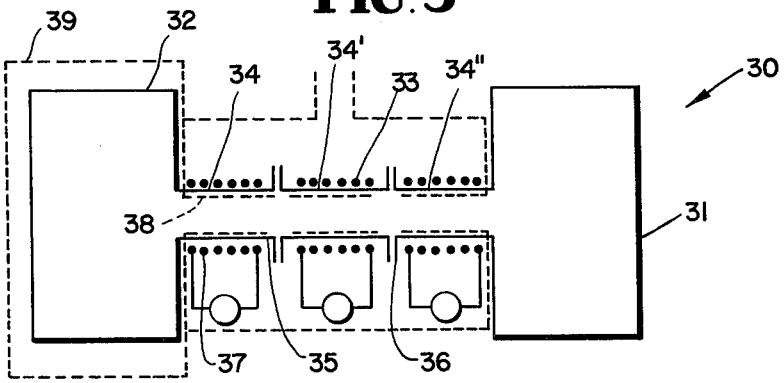
FIG. 3 shows a pumping system employing one embodyment of a connecting means according to the present invention.

FIG. 3 shows a more detailed representation 30 of a pumping system employing a connection means of the present invention in which a vacuum pump 31 is connected to a chamber to be evacuated 32 by connection means 33. Connection means 33 comprises three segments 34 34' 34''. Segment 34 comprises a stainless steel wall 35 terminating in a vacuum flange 36. Wall 35 is surrounded by an electrically insulated heating wire 37 of high electrical resistance. The internal surface of wall 35 is coated with a gas sorbing material 38. Segments 34' and 34'' are identical to segment 34 except that segment 34' has a vacuum flange at both ends. Chamber 32 and connection means 33 may be further surrounded by a vacuum jacket 39, indicated by a dotted line, to reduce to a minimum any permeation of gas through the stainless steel walls 35.

Figure 4:
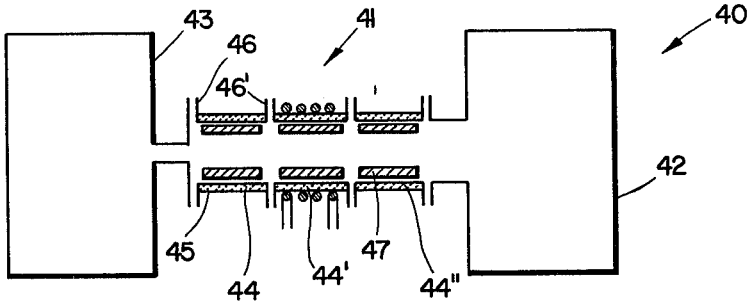
FIG. 4 shows a pumping system employing a further embodiment of a connecting means according to the present invention.

FIG. 4 shows a further representation 40 of a pumping system employing a connecting means 41 of the present invention which connects a vacuum pump 42 to a vessel to be pumped 43. Connecting means 41 comprises sections 44, 44', 44''. Section 44 comprises a ceramic wall 45 at each end of which is attached a metal vacuum flange 46, 46'.

Enclosed by the ceramic wall 45 is a cartridge 47 in the form of a hollow cylinder or support materials which is a nickle-chrome network which defines a multiplicity of interconnecting free cells at least partially filled with a partially sintered mixture of powdered zirconium and a powdered alloy of zirconium and aluminium.

Section 44'' is of the same construction as section 44 whereas section 44', while similar, is also provided with a wire of high electrical resistance wound into a groove on the outer surface of the ceramic wall. As the wall is ceramic, any heating which may be required of cartridge 47 may be accomplished by induction heating.

Figure 5:
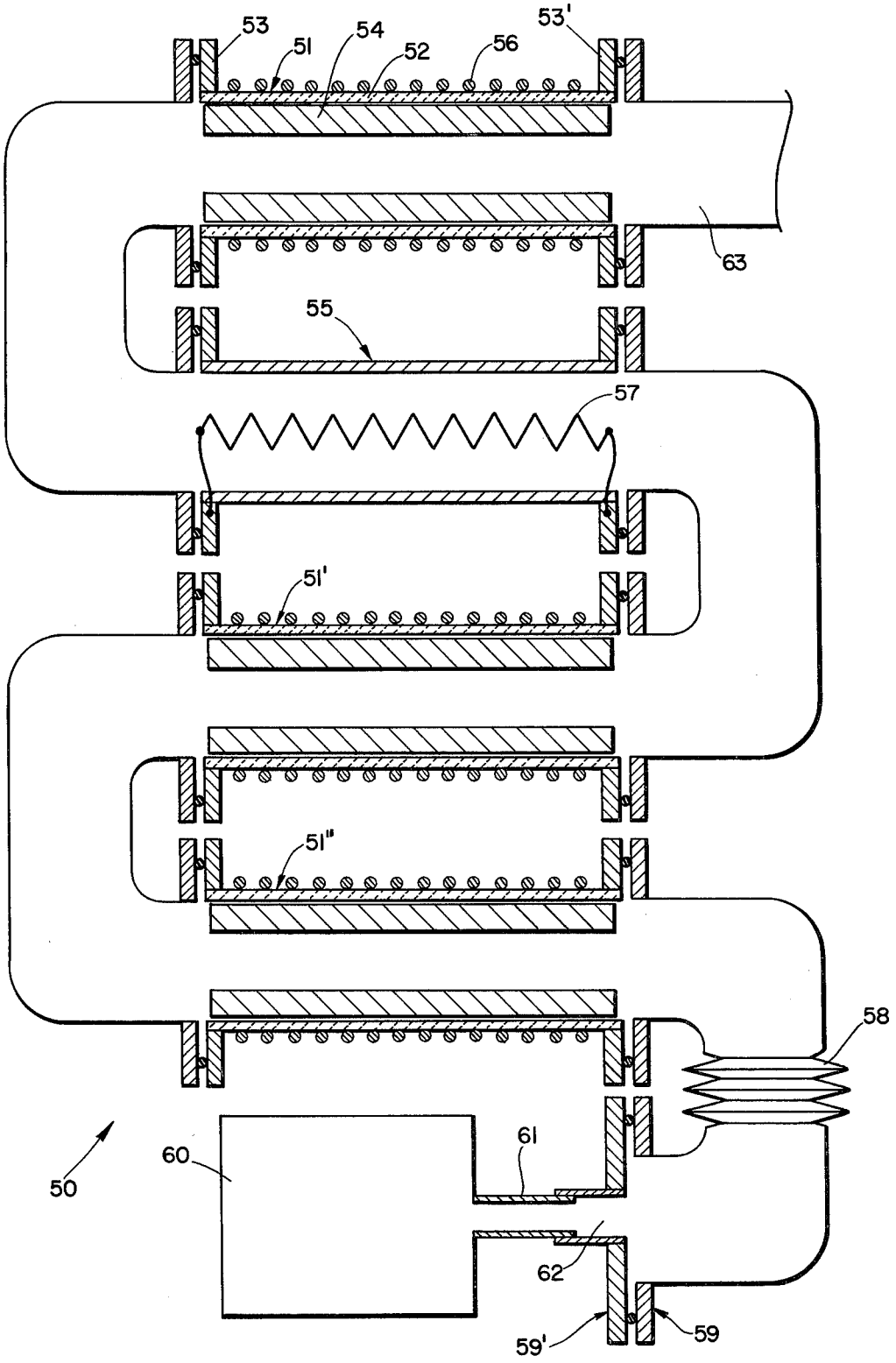
FIG. 5 is a further illustration of a pumping system employing an embodyment of connecting means of the present invention.

FIG. 5 shows a further representation 50 of a pumping system employing connection sections 51, 51', 51'' forming a connecting means of the present inventions. Section 51 comprises a ceramic ($Al_2O_3$) cylinder 52 at each end of which is a vacuum flange 53, 53'. In thermal contact with the inner surface of wall 52 is a cartridge 54 in the form of a hollow cylinder of support material in the form of a nickel chrome network which defines a multiplicity of interconnecting free cells at least partially filled with a partially sintered mixture of powdered zirconium and powdered graphite as an antisintering agent. A high electrical resistance wire 56 is place in a spiral groove in the outer wall of cylinder 52. Sections 51 and 52 are identical. A further section 55 is placed between sections 51 and 51' in which there has been placed a filament 57 but no gas sorbing cartridge. The purpose of filament 57 is to crack hydrocarbons thus transforming them into hydrogen which can be sorbed by the active material of the cartridges within sections 51 and 51'. Section 51'' is joined by means of bellows 58, to act as a shock and vibration decoupler, to a further flange 59. Flange 59 is coupled to a further flange 59' which in turn are connected to the chamber to be pumped 60 by means of pinch-off 61. A bakable vacuum valve (not shown) can be placed at mouth 62 of flange 59' to isolate the pumping system during replacement of chamber 60.

Mouth 63 of section 51 leads to a known pumping system.

In order to evacuate a chamber according to the present invention, the chamber is connected to a pumping system as illustrated in FIG. 5. Mouth 63 is connected to a turbo-molecular pump and flange 59' is connected to the chamber to be pumped via a small pinch-off tube 61. A turbo-molecular pump is operated and pumps the chamber and connecting means to a vacuum of the order of $10^{-7}$ torr. As this value of pressure the rate of decreases of pressure has slowed down considerably. System 50, connecting means and chamber 60, is placed in an oven whose temperature is raised to about 500° C in order to degas the components and surfaces. Filament 57 is heated to 1200° C or more, by passing an electric current through it, to remove previously sorbed gases. The cartridges are activated by heating them to about 950° C for 20 minutes by means of the heating coils surrounding each ceramic tube whereupon they become capable of sorbing gas. The oven is removed and the temperature of each cartridge is adjusted. The cartridges at each side of filament 57 can be held at about 200° C so that hydrogen, produced by cracking of hydrocarbons on hot filament 57 are sorbed. Thus the hydrogen cannot return to the chamber neither does it go to the turbo-molecular pump where it would be less efficiently pumped.

The cartridge nearest the chamber is maintained at about 400° C to maximize its gas sorption properties towards other gases. If chamber 60 is, for example, an electron tube it can be operated to degas further its component parts. It can also be placed in a separate oven to degas further its walls and so forth.

When the chamber has been pumped to the desired level of vacuum and has been sufficiently degased it is sealed by pinching off tube 61. The value at mouth 62 can be closed to isolate the vacuum pumping system. Evacuated chamber 60 is moved.

Although the invention has been described in considerable detail with reference to certain preferred embodiments thereof, it will be understood that modifications can be effected within the spirit and scope of the invention as described above and as defined in the appended claims.

What is claimed is:

1. Means for connecting a vacuum pump to a chamber to be evacuated, said means comprising:
   (a) an outer wall of low gas permeability,
   (b) a gas sorptive means for sorbing gas, the gas sorptive means being substantially co-extensive with an inner surface of the outer wall and removable with respect to the outer wall, the gas sorptive means comprising:
      (i) a support means comprising a porous network defining a multiplicity of interconnecting free cells and
      (ii) a gas sorptive material comprising the said supporting porous network of interconnecting free cells at least partially filled with non-evaporable, partially sintered getter powder, the getter powder consisting essentially of a metal or an alloy of a metal selected from the group or Zr, Ti, Ta, Nb, and V, and having a sorptive capacity for oxygen, hydrogen, carbon monoxide and water vapor and a vapor pressure of less then $10^{-5}$ torr at 1000° C, and
   (c) a heating means for heating the gas sorptive means, the heating means located outside of but in thermal relationship with the outer wall.

2. A connecting means of claim 1 in which the outer wall of low gas permeability is metallic.

3. A connecting claim 2 in which the metal is stainless steel.

4. A connecting means of claim 1 in which the outer wall of low gas permeability is ceramic.

5. A connecting means of claim 4 in which the ceramic comprises $Al_2O_3$.

6. A connecting means of claim 1 in which the heating means is a high electrical resistance wire.

7. A connecting means of claim 6 in which the resistance wire is covered by an electrically insulating coating.

8. A connecting means of claim 6 in which the resistance wire lies in a groove in the outer surface of the wall.

9. A connecting means of claim 1 provided with at least one end flange.

10. The connecting means of claim 1 wherein said gas sorptive material further comprises an antisintering agent mixed with said non-evaporable getter material.

11. The connecting means of claim 1 wherein said porous network is a porous, nickel-chrome network.

12. Means for connecting a vacuum pump to a chamber to be evacuated, said means comprising:
   (a) an outer wall of low gas permeability,
   (b) a gas sorptive means for sorbing gas, the gas sorptive means being substantially co-extensive with an inner surface of the outer wall and removable with respect to the outer wall, the gas sorptive means comprising:
      (i) a support means comprising a porous network defining a multiplicity of interconnecting free cells and
      (ii) a gas sorptive material supported within and partially filling the interconnecting free cells of the support means, having a sorptive capacity for oxygen, hydrogen, carbon monoxide and water vapor, a vapor pressure of less than $10^{-5}$ torr at 1000° C, and comprising a non-evaporable, partially sintered mixture of an anti-sintering agent mixed with a getter powder consisting essentially of a metal or an alloy of a metal selected from the group of Zr, Ti, Ta, Nb, and V, and
   (c) a heating means for heating the gas sorptive means, the heating means located outside of but in thermal relationship with the outer wall.

13. Means for connecting a vacuum pump to a chamber to be evacuated said means comprising at least two sections, each section comprising:
   (a) an $Al_2O_3$ ceramic cylinder forming a tubular wall having an inner and an outer surface, the outer surface having a helical groove, each end of the ceramic cylinder having fixed thereto a vacuum flange,
   (b) a replaceable cartridge in the form of a hollow cylinder positioned in contact with and being substantially co-extensive with the inner surface of the tubular wall, the replaceable cartridge comprising a nickel-chrome network which defines a multiplicity of interconnecting free cells, the free cells being at least partially filled with a partially sintered mixture of powdered zirconium and powdered graphite, and a powdered alloy of zirconium and aluminum having a composition of 5% - 30% aluminum, the balance zirconium and a vapor pressure of less than $10^{-5}$ torr at 1000° C, and (c) a wire of high electrical resistance wound into the groove on the outer surface of the ceramic cylinder.

14. The connecting means of claim 13 further comprising at least one further section placed between a pair of said at least two sections, said further section comprising:

(a) an $Al_2O_3$ ceramic cylinder forming a tubular wall at each end of which is fixed a vacuum flange, and (b) an electrically resistive wire filament positioned within the cylinder for cracking hydrocarbons thus transforming them into hydrogen and other gases which can be sorbed by active materials present in said replaceable cartridges within said at least two sections.

* * * * *